US011438984B2

(12) United States Patent
Yang

(10) Patent No.: US 11,438,984 B2
(45) Date of Patent: Sep. 6, 2022

(54) LINEAR DRIVE ENERGY RECOVERY SYSTEM

(71) Applicant: iDESYN Semiconductor Corp., Zhubei (TW)

(72) Inventor: Shih-Hsueh Yang, Zhubei (TW)

(73) Assignee: Idesyn Semiconductor Corp., Zhubei (TW)

( * ) Notice: Subject to any disclaimer, the term of this patent is extended or adjusted under 35 U.S.C. 154(b) by 52 days.

(21) Appl. No.: 16/788,722

(22) Filed: Feb. 12, 2020

(65) Prior Publication Data

US 2020/0260553 A1 Aug. 13, 2020

(30) Foreign Application Priority Data

Feb. 13, 2019 (TW) ..... 108104824

(51) Int. Cl.
*H05B 45/395* (2020.01)
*G05F 1/10* (2006.01)

(52) U.S. Cl.
CPC ..... *H05B 45/395* (2020.01); *G05F 1/10* (2013.01)

(58) Field of Classification Search
CPC .... H05B 45/14; H05B 45/325; H05B 45/345; H05B 45/36; H05B 45/48; H05B 45/10; H05B 45/30; H05B 45/34; H05B 45/37; H05B 45/39; H05B 45/395; H05B 45/50; H05B 45/56; H05B 47/135
See application file for complete search history.

(56) References Cited

U.S. PATENT DOCUMENTS

2013/0063047 A1* 3/2013 Veskovic ..... H05B 45/14 315/307
2018/0063918 A1* 3/2018 Nakamura ..... B60Q 1/0094
2018/0224074 A1* 8/2018 Xiong ..... H05B 45/00

* cited by examiner

*Primary Examiner* — Monica C King
(74) *Attorney, Agent, or Firm* — Muncy, Geissler, Olds & Lowe, P.C.

(57) ABSTRACT

The present invention provides a linear drive energy recovery system, comprising a power source module, a primary working load module, and a secondary working load module, wherein the power source module is connected to the primary working load module, and the secondary working load module is connected in series to the primary working load module such that a voltage provided by the power source module minus a voltage drop caused by the primary working load module is supplied to the secondary working load module as an operating voltage of the secondary working load module.

10 Claims, 2 Drawing Sheets

LINEAR DRIVE ENERGY RECOVERY SYSTEM

BACKGROUND OF THE INVENTION

1. Technical Field

The present invention relates to a driving circuit system and more particularly to a driving circuit system that can recover linear drive energy in order for a secondary load to use the recovered energy.

2. Description of Related Art

A light-emitting diode (LED) lamp is a lighting device that uses one or more LEDs as the light source, wherein the one or more LEDs are typically made of semiconductors. With the advancement of LED technology, high-power and high-luminance LEDs have gradually replaced the conventional light sources.

As a low-voltage semiconductor product, LEDs will be damaged by a high-than-rated voltage and therefore cannot be driven by a standard alternating-current (AC) power source directly; an additional circuit is required to control the supply of voltage and current. This circuit includes a series of diodes and resistors and is configured to control the polarity of the output voltage and limit the output current, which operations, however, cause a loss of voltage by converting any excess voltage into heat. To address the issue of heat loss and thereby reduce the loss of voltage, it is common practice to connect a plurality of LEDs in series, but this circuit configuration gives rise to another problem: should any of the series-connected LEDs be damaged, all the LEDs in the circuit will be unable to emit light.

BRIEF SUMMARY OF THE INVENTION

The primary objective of the present invention is to provide a linear drive energy recovery system, comprising a power source module, a primary working load module, and a secondary working load module, wherein the power source module is connected to the primary working load module, and the secondary working load module is connected in series to the primary working load module such that a voltage provided by the power source module minus a voltage drop caused by the primary working load module is supplied to the secondary working load module as an operating voltage of the secondary working load module.

Comparing to the conventional techniques, the present invention has the following advantages:

The present invention recovers and reuses the electric energy that may otherwise be lost as heat but that is intended for use by a load in the first place. Thus, in addition to preventing an undesirable temperature rise of the device to which the invention is applied, the invention saves energy by reducing the power consumption of the entire circuit of the device.

Furthermore, the present invention uses a weighting controller and a variable-impedance controller to modulate the divided voltage across a secondary load module so as to ensure that the current flowing through the primary load module is in a constant state.

DETAILED DESCRIPTION OF THE INVENTION

The details and technical solution of the present invention are hereunder described with reference to accompanying drawings. For illustrative sake, the accompanying drawings are not drawn to scale. The accompanying drawings and the scale thereof are not restrictive of the present invention.

A detailed description of how to implement the present invention is given below with reference to FIG. 1, which is a block diagram of a linear drive energy recovery system according to the invention.

Figure 1:
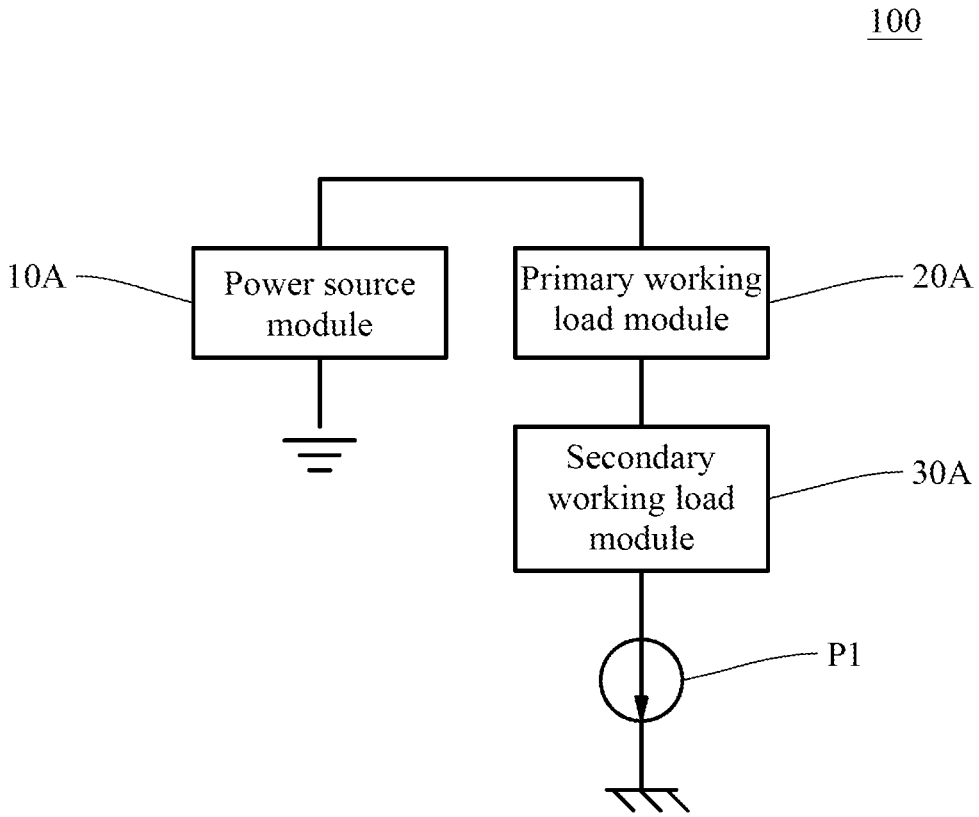
FIG. 1 is a block diagram of a linear drive energy recovery system according to the present invention.

As shown in FIG. 1, the present invention provides a linear drive energy recovery system 100 that features weighted current control. The linear drive energy recovery system 100 essentially includes a power source module 10A, a primary working load module 20A, and a secondary working load module 30A.

The power source module 10A, whose output is connected to the primary working load module 20A, is used to provide the electric energy required for driving the primary working load module 20A. The power source module 10A in a preferred embodiment is selected from the group consisting of a rectifier, a voltage stabilizer, a transformer, a relay, and a surge protection unit (or other circuit protection modules); the present invention, however, has no limitation in this regard.

The primary working load module 20A and the secondary working load module 30A may be any working circuits. The secondary working load module 30A is connected in series to the primary working load module 20A such that the voltage provided by the power source module 10A minus the voltage drop caused by the primary working load module 20A is supplied to the secondary working load module 30A as the operating voltage of the secondary working load module 30A.

In a preferred embodiment, the primary working load module 20A is preferably connected to a working circuit that requires high power and relatively stable input, whereas the secondary working load module 30A is a working circuit configured to be driven by linearly or non-linearly variable power. By keeping the total output current (e.g., the current at node P1) at a constant value, the performance of the primary working load module 20A, through which a constant current flows, can be determined.

An embodiment of the present invention is detailed below with reference to FIG. 2, which is the circuit diagram of a linear drive energy recovery system according to the invention that is used as an LED driving circuit.

Figure 2:
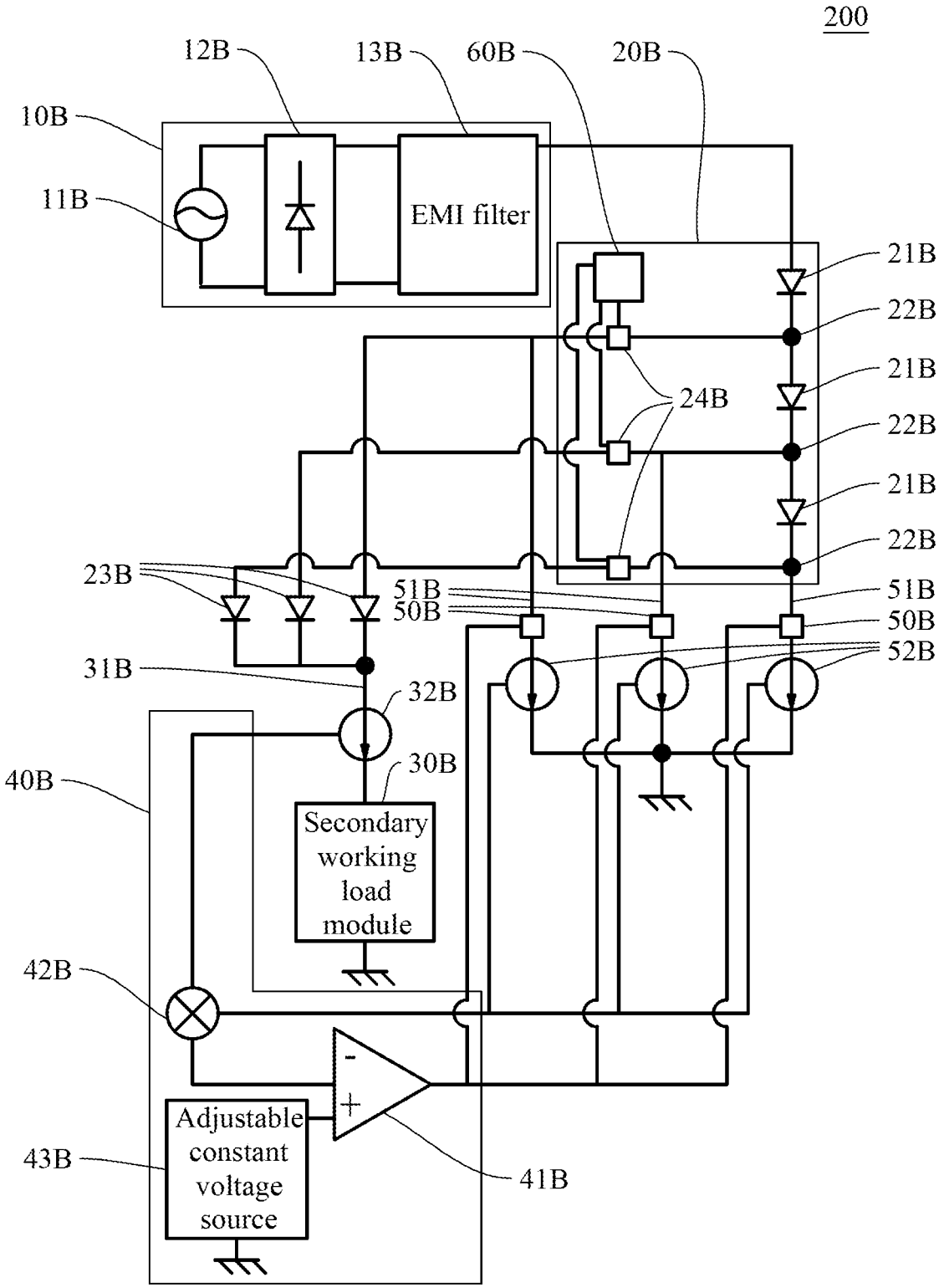
FIG. 2 is a circuit diagram of a linear drive energy recovery system according to the present invention that is used as an LED driving circuit.

As shown in FIG. 2, the constant-current-source driving system 200 disclosed in this embodiment includes a power source module 10B, a primary working load module 20B, a secondary working load module 30B, and a weighting controller 40B.

The power source module 10B essentially includes a rectifier 12B connected to mains electricity 11B and an electromagnetic interference filter (EMI filter) 13B connected to the rear end of the rectifier 12B. The rectifier 12B in a preferred embodiment is a half-wave rectifier, a full-wave rectifier, or a bridge rectifier in order to convert the mains electricity into direct-current (DC) electricity. The present invention has no limitation on the mode of implementing the rectifier 12B. The EMI filter 13B is provided at the rear end of the rectifier 12B to filter out the noise in the electricity output from the rectifier 12B and thereby achieve voltage stabilization as well as current stabilization.

The primary working load module 20B is connected to the power source module 10B in order to be driven by the electricity provided by the power source module 10B. In this embodiment, the primary working load module 20B includes a plurality of series-connected or parallel-connected load units 21B, wherein each load unit 21B is a light-emitting unit or light-emitting array composed of one or a plurality of LEDs. To adjust the brightness of the light-emitting units or arrays (hereinafter referred to collectively as the light source for short), the rear end of each load unit 21B is provided with a tap 22B not only connected to the secondary working load module 30B but also parallel-connected to a corresponding one of the variable-impedance controllers 50B of the secondary working load module 30B.

The secondary working load module 30B is connected to the primary working load module 20B and is parallel-connected to the plural variable-impedance controllers 50B through the taps 22B respectively. To prevent problems associated with the generation of a reverse current in the circuits (e.g., a short circuit caused by a current flowing from one of the taps to another tap), there is a forward-biased diode 23B between the rear end of each load unit 21B and the secondary working load module 30B, the objective being for the forward-biased diodes 23 to isolate the secondary working load module 30B and the variable-impedance controllers 50B from the load units 21B. The number of the variable-impedance controllers 50B must correspond to that of the taps 22B to enable multipath voltage control.

To control the brightness of the light source (which is determined by the number of the LEDs activated), the circuit of each tap 22B is provided with a switch unit 24B, and each switch unit 24B is connected to a controller 60B in order to be turned on or off under the control of the controller 60B.

In this embodiment, the secondary working load module 30B may be a micro control unit (MCU), a sensor, or a constant-voltage or constant-current driving module; the present invention has no limitation in this regard. In a preferred embodiment, the variable-impedance controllers 50B are field-effect transistor (FET)-based voltage control resistors, whose resistance values are determined by their respective input voltage values.

The weighting controller 40B is connected to the first circuit 51B of each variable-impedance controller 50B in order to obtain the first current value of each first circuit 51B. The weighting controller 40B is also connected to the second circuit 31B of the secondary working load module 30B in order to obtain the second current value of the second circuit 31B. By comparing the sum of the first current values and the second current value with a preset target current value and sending a control signal to each variable-impedance controller 50B as feedback, the weighting controller 40B ensures that a constant current is supplied to the primary working load module 20B.

More specifically, the weighting controller 40B includes a controller 41B connected to the variable-impedance controllers 50B and a weighter 42B connected to the first circuits 51B of the variable-impedance controllers 50B and the second circuit 31B of the secondary working load module 30B. To obtain the first current value of each first circuit 51B and the second current value of the second circuit 31B, the first circuit 51B of each variable-impedance controller 50B is provided with a first current sensor 52B for sensing the corresponding first current, and the second circuit 31B of the secondary working load module 30B is provided with a second current sensor 32B for sensing the second current. In a preferred embodiment, the first current sensors 52B and the second current sensor 32B are current-sensing resistors or power transistors. To maintain a constant current, the weighter 42B sums the first current values of the first circuits 51B and the second current value of the second circuit 31B; outputs the sum to the controller 41B, where the sum is compared with a preset target current value; and sends a control signal to each variable-impedance controller 50B as feedback in order for the primary working load module 20B to be supplied with a constant current.

In this embodiment, the signals obtained from the first current sensors 52B and the second current sensor 32B are voltage values. The weighter 42B sums the voltage values and sends the sum to the negative input of the controller 41B. The positive input of the controller 41B is connected to an adjustable constant voltage source 43B. Based on the electrical potential difference between its positive and negative inputs, the controller 41B outputs through its output end a control signal for changing the impedance value of each variable-impedance controller 50B. The voltage value of the adjustable constant voltage source 43B can be adjusted via the controller 60B in order to produce the desired lighting mode. In another preferred embodiment, the signals obtained from the current sensors are current values instead; the present invention has no limitation in this regard.

The foregoing configuration is such that, when the operating voltage of the secondary working load module 30B is changed, the weighting controller 40B can track the resulting current value changes in real time and modulate the impedance values of the variable-impedance controllers 50B accordingly so as to keep a constant current through the primary working load module 20B. In the meantime, the voltage recovered is used to drive the secondary working load module 30B such that an energy-saving effect is produced.

In summary of the above, the present invention recovers and reuses the electric energy that may otherwise be lost as heat but that is intended for use by a load in the first place. Thus, in addition to preventing an undesirable temperature rise of the device to which the invention is applied, the invention saves energy by reducing the power consumption of the entire circuit of the device. Furthermore, the present invention uses a weighting controller and a variable-impedance controller to modulate the divided voltage across a secondary load module so as to ensure that the current flowing through the primary load module is in a constant state.

The above is the detailed description of the present invention. However, the above is merely the preferred embodiment of the present invention and cannot be the limitation to the implement scope of the invention, which means the variation and modification according to the present invention may still fall into the scope of the invention.

What is claimed is:

1. A linear drive energy recovery system, comprising a power source module, a primary working load module, a secondary working load module, a weighting controller, and a variable-impedance controller, the primary working load module is a working circuit that requires stable input, the secondary working load module is a working circuit configured to be driven by linearly or non-linearly variable power, the weighting controller connects to the variable-impedance controller which is connected in series to the primary working load module and connected in parallel to the secondary working load module, wherein the power source module is connected to the primary working load module, and the secondary working load module is connected in series to the primary working load module such that a voltage provided by the power source module minus a voltage drop caused by the primary working load module is supplied to the secondary working load module as an operating voltage of the secondary working load module, and the weighting controller adjusts the variable-impedance controller's passing current to keep a constant current passing through the primary working load module.

2. The linear drive energy recovery system of claim 1, wherein the variable-impedance controller is parallel-connected to the secondary working load module, the linear drive energy recovery system further including a controller connected to the variable-impedance controller, and a weighter connected to a first circuit of the variable-impedance controller and a second circuit of the secondary working load module, wherein the weighter sums a first current value of the first circuit and a second current value of the second circuit, outputs the sum to the controller, where the sum is compared with a preset target current value, and sends a control signal to the variable-impedance controller as feedback in order for the primary working load module to be supplied with a constant current and to distribute energy to required modules.

3. The linear drive energy recovery system of claim 2, wherein the weighter is connected to a first current sensor provided on the first circuit of the variable-impedance controller to obtain the first current value, and the weighter is connected to a second current sensor provided on the second circuit of the secondary working load module to obtain the second current value.

4. The linear drive energy recovery system of claim 3, wherein the first current sensor and the second current sensor are current-sensing resistors or power transistors.

5. The linear drive energy recovery system of claim 2, wherein the variable-impedance controller is a field-effect transistor (FET)-based voltage control resistor.

6. The linear drive energy recovery system of claim 1, wherein the power source module includes a rectifier connected to mains electricity and an electromagnetic interference filter (EMI filter) connected to a rear end of the rectifier.

7. The linear drive energy recovery system of claim 1, wherein the primary working load module includes a plurality of series-connected load units, a rear end of each load unit is provided with a tap connected to the secondary working load module and the variable-impedance controller, and corresponding forward-biased diodes are respectively arranged in parallel between the rear end of the load unit and the secondary working load module.

8. The linear drive energy recovery system of claim 7, wherein the tap is provided with a switch unit, and the switch unit is connected to a controller in order to be turned on or off under the control of the controller.

9. The linear drive energy recovery system of claim 7, wherein the load unit is a light-emitting unit or light-emitting array composed of one or a plurality of light-emitting diodes.

10. The linear drive energy recovery system of claim 1, wherein the secondary working load module is a micro control unit (MCU), a sensor, or a constant-voltage or constant-current driving module.

* * * * *